US005785503A

United States Patent [19]

Ota et al.

[11] Patent Number: 5,785,503

[45] Date of Patent: Jul. 28, 1998

[54] VARIABLE DISPLACEMENT COMPRESSOR

[75] Inventors: Masaki Ota; Hisakazu Kobayashi; Youichi Okadome; Masaru Hamasaki, all of Kariya, Japan

[73] Assignee: Kabushiki Kaisha Toyoda Jidoshokki Seisakusho, Kariya, Japan

[21] Appl. No.: 755,416

[22] Filed: Nov. 22, 1996

[30] Foreign Application Priority Data

Nov. 24, 1995 [JP] Japan ..... 7-305797
Sep. 13, 1996 [JP] Japan ..... 8-243312

[51] Int. Cl.[6] ..... F04B 1/12

[52] U.S. Cl. ..... 417/269; 74/60; 92/71

[58] Field of Search ..... 417/222.2, 269; 92/12.2, 71; 74/60

[56] References Cited

U.S. PATENT DOCUMENTS

| | | | |
|---|---|---|---|
| 4,533,299 | 8/1985 | Swain et al. . | |
| 5,105,728 | 4/1992 | Hayase et al. . | |
| 5,231,914 | 8/1993 | Hayase et al. . | |
| 5,387,091 | 2/1995 | Kawaguchi et al. | 417/222.2 |
| 5,681,150 | 10/1997 | Kawaguchi et al. | 417/222.2 |

FOREIGN PATENT DOCUMENTS

| | | |
|---|---|---|
| 0568944 | 11/1993 | European Pat. Off. . |
| 0623744 | 11/1994 | European Pat. Off. . |
| 3545200 | 7/1986 | Germany . |
| 6427482 | 2/1989 | Japan . |
| 552183A | 3/1993 | Japan . |
| 6264865 | 9/1994 | Japan . |
| 07279840 | 10/1995 | Japan . |
| 07293433 | 11/1995 | Japan . |
| 07293434 | 11/1995 | Japan . |

*Primary Examiner*—Charles G. Freay
*Attorney, Agent, or Firm*—Brooks Haidt Haffner & Delahunty

[57] ABSTRACT

A swash plate is mounted on a drive shaft in a crank chamber. The swash plate rotates integrally with the drive shaft and changes its inclination angle based on the pressure in the crank chamber. Pistons are provided in cylinder bores and coupled to the swash plate. The rotation of the swash plate is converted into reciprocation of each piston in the associated cylinder bore. The pistons'reciprocation draws the gas from a suction chamber into the compression chamber. The gas is compressed and discharged into the discharge chamber. A lug plate that integrally rotates with the drive shaft is mounted on the drive shaft. The lug plate has a receptacle. The receptacle has a pair of side walls that are spaced apart. The swash plate has an arm extending perpendicular to the swash plate. The arm has a distal end surface extending perpendicular to the axis of the drive shaft. The head slides along the receptacle and receives a load from the swash plate.

18 Claims, 5 Drawing Sheets

VARIABLE DISPLACEMENT COMPRESSOR

BACKGROUND OF THE INVENTION

1. Field of the Invention

The present invention relates to a variable displacement compressor. More particularly, the present invention relates to a variable displacement compressor having single-headed pistons.

2. Description of the Related Art

In swash plate type compressors employed in vehicle air conditioning systems, refrigerant gas is drawn from an external cooling circuit into a compression chamber via a suction chamber. The gas is then compressed by a piston and discharged outside of the compressor via a discharge chamber. Some compressors have a swash plate connected to a lug plate by a hinge mechanism in a crank chamber. The swash plate is tiltable with respect to a drive shaft. The swash plate is coupled to pistons by shoes. The stroke of the pistons, and the compressor displacement correspond to the inclination angle of the swash plate.

The gas pressure in the cylinder bore acts on the front end surface of the pistons and the gas pressure in the crank chamber acts on the rear end surface of the pistons. The inclination angle of the swash plate changes in accordance with the difference of the gas pressure in the cylinder bore and the gas pressure in the crank chamber. Changing the gas pressure in the crank chamber changes the inclination angle of the swash plate, thereby adjusting the displacement of the pressure to be suitable for the temperature in the passenger compartment of the vehicle.

Japanese Unexamined Patent Publication 6-264865 discloses such a compressor. The compressor has a lug plate that is integrally rotatable with the drive shaft and a swash plate provided next to the lug plate. An elongated hole is formed in either the lug plate or the swash plate and a pin is provided on the other. The pin is inserted in the elongate hole to transmit the torque of the drive shaft to the swash plate. The pin and the hole also serve as a hinge mechanism that allows the inclination angle of the swash plate to be changed.

However, the above hinge mechanism requires a rather complicated manufacturing process. Further, a retaining ring needs to be fitted to the pin to prevent the pin from coming out of the elongated hole. This increases the number of parts in the compressor. The complicated manufacturing process and increased number of the parts increase the manufacturing cost of the compressor. In addition, made typically with iron, the pin provided on the swash plate adds extra weight to the compressor.

The axis of the pin is parallel to the swash plate and perpendicular to the drive shaft and the pistons' reciprocating direction. This structure makes the cantilever-like pin susceptible to the bending moment of the thrust load that acts on the swash plate every time the piston compresses the gas. This gives an undesirable inclination to the swash plate along the axis of the cantilever-like pin. Therefore, operating the compressor with a high speed or with a high pressure ratio wears the pin and the hole. The wearing of the pin and the hole affects the rotation torque and the inclination of the swash plate.

The swash plate has a through hole into which the drive shaft is inserted. The wall of the through hole contact the drive shaft. The swash plate slides on the drive shaft with the through hole's ends contacting the shaft. Long term use of the compressor wears the wall of the through hole and a part of the drive shaft contacting the through hole. This degrades the swash plate's responsiveness to the pressure in the crank chamber, that is, the swash plate does not quickly change its inclination angle in accordance with the changes of the pressure in the crank chamber. This hinders the compressor's responsiveness to the temperature changes in the passenger compartment.

SUMMARY OF THE INVENTION

Accordingly, it is an objective of the present invention to provide a compressor that changes its displacement to accurately respond to the temperature of the passenger compartment.

It is another objective of the present invention to provide a compressor that is easy to manufacture at low cost.

It is yet another objective of the present invention to provide a compressor having a reduced weight.

To achieve the foregoing and other objectives and in accordance with the purpose of the present invention, an improved compressor having a rotating plate that rotates integrally with a drive shaft is provided. Rotation of the drive shaft is converted into reciprocation of pistons coupled to the rotating plate. The compressor has a lug plate mounted on the drive shaft. The lug plate rotates integrally with the drive shaft. Either the lug plate or the swash plate has a receptacle and the other has an arm. The arm is guided along the receptacle. The receptacle has a pair of side walls that are spaced apart. The width of the arm is substantially equal to the space between the side walls.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 3 is a partial plan view illustrating the hinge mechanism of

FIG. 2;

FIG. 6 is a partial cross-sectional view taken along line 6—6 of

FIG. 5;

DETAILED DESCRIPTION OF THE PREFERRED EMBODIMENTS

A first embodiment of the present invention will now be described with reference to the drawings.

Figure 1:
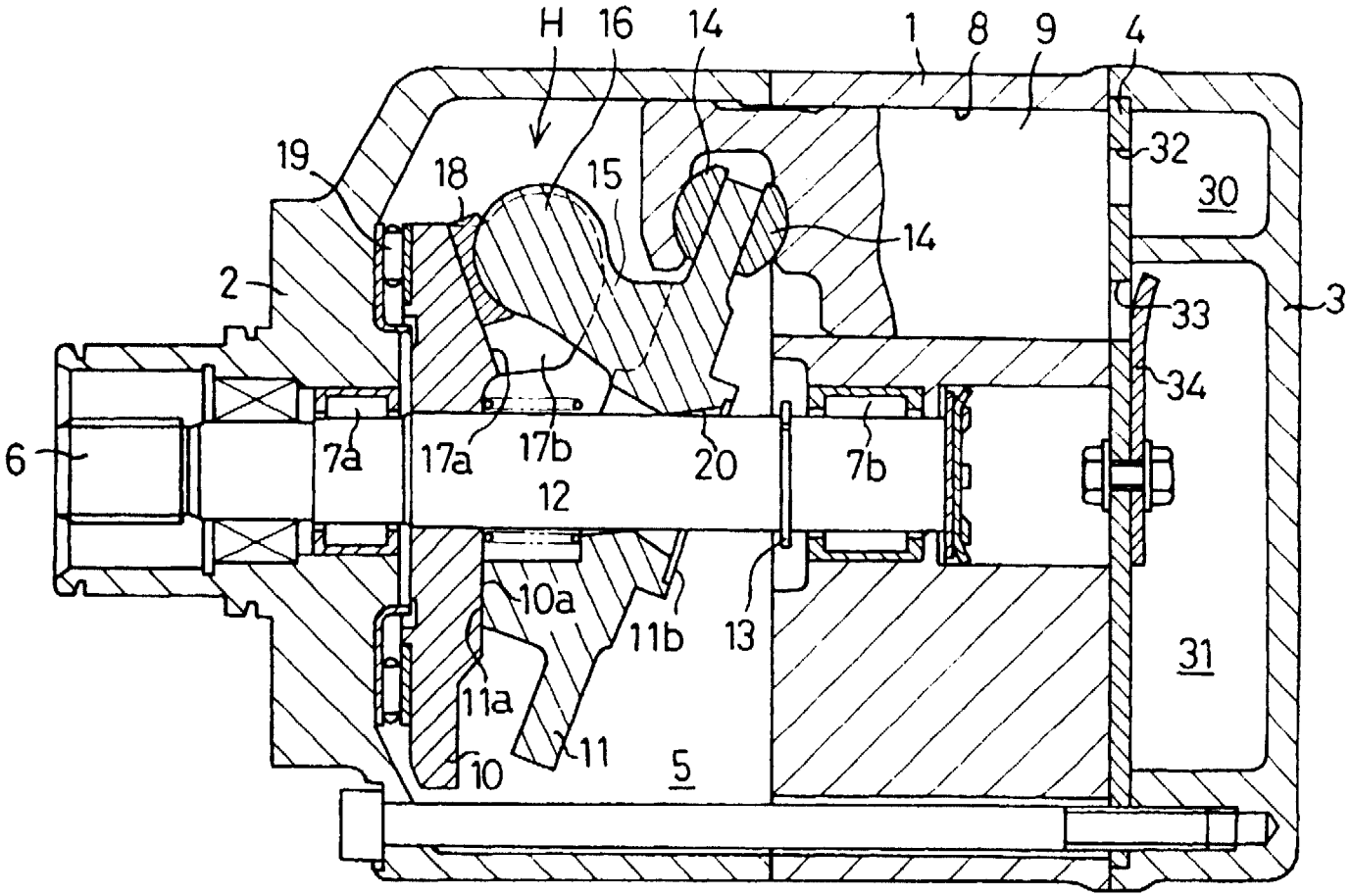
FIG. 1 is a cross-sectional view illustrating a variable displacement compressor according to the present invention.

As shown in FIG. 1, a front housing 2 is secured to a cylinder block 1. A rear housing 3 is secured to the rear end of the cylinder block 1 with a valve plate 4 arranged in between. The cylinder block 1 and the front housing define a crank chamber 5. A drive shaft 6 is supported by bearings 7*a*, 7*b*in the crank chamber 5. A plurality of cylinder bores 8 are formed extending through the cylinder block 1 about the drive shaft 6. The bores 8 are arranged parallel to the drive shaft 6 with a predetermined interval between each adjacent bore 8. A piston 9 is housed in each bore 8.

A lug plate 10 is attached to the drive shaft 6 in the crank chamber 5. The lug plate 10 is supported by the front housing 2 with a bearing 19 arranged in between.

A circular swash plate 11 is supported by the drive shaft 6 behind the lug plate 10. The swash plate 11 is made of aluminum alloy. The swash plate 11 has a through hole 20 formed in the center thereof. The drive shaft 6 is inserted in the through hole 20. The swash plate 11 is coupled to the lug plate 9 by a hinge mechanism H in such a manner that the swash plate 11 rotates with the drive shaft 6 and slides along and inclines with respect to the axis of the drive shaft 6.

Figure 8:
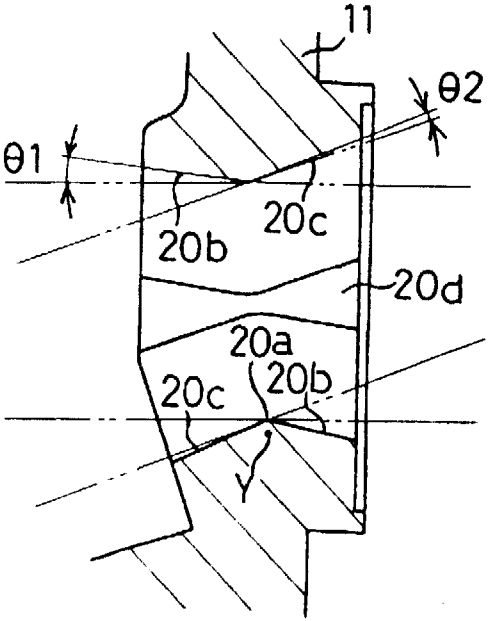
FIG. 8 is a partial side cross-sectional view illustrating the engagement of a through hole of a swash plate and a drive shaft.

FIG. 8 shows the structure of the through hole 20 according to the present invention. The diameter of the hole 20 is wider at each end than that at its center. The hole 20 thus allows the swash plate 11 to incline without interference.

The supporting part 20*a*, which protrudes most inwardly, has a cross-section that forms an arc with the axis Y as the center of the arc. The drive shaft 6 contacts the part 20*a*. Slanted surfaces 20*b* and 20*c* are formed in the hole 20 with the supporting part 20*a*in between. When the shaft 6 contacts the surface 20*b*, the swash plate 11 is positioned at its minimum inclination. When the shaft 6 contacts the surface 20*c*, the swash plate 11 is positioned at its maximum inclination. A buffer inclination angle θ1 of 10 to 15 degrees is given to the surface 20*b* and a buffer inclination angle θ2 of 1 to 2 degrees is given to the surface 20*c*. A flat restriction surface 20*d* is formed on each side of the hole 20.

As shown in FIG. 1, the swash plate 11 is urged backward by a coil spring 12 placed between the lug plate 10 and the swash plate 11. Each piston 9 has a recess in which a pair of semispherical shoes 14 are accommodated. The swash plate 11 is coupled to each piston 9 with the pair of shoes 14 provided on the front and rear sides of the peripheral portion of the swash plate 11. That is, the periphery of the plate 11 is inserted in the recess formed in the front end of each piston 9. The rotation of the swash plate 11 is converted into reciprocation of each piston 9 in the associated cylinder bore 8 by each pair of shoes 14.

Each piston 9 reciprocates between the top dead center position and the bottom dead center position in accordance with the rotation of the swash plate 11. In FIG. 1, the piston 9 is at the top dead center position and has discharged the compressed refrigerant gas into a discharge chamber 31. One of the other pistons 9 (not shown) is close to the bottom dead center position. When at bottom dead center, the pistons 9 draw the refrigerant gas into the compression chamber from a suction chamber 30. In this specification, the position of the swash plate that allows piston 9 to be at top dead center is referred to as the "top dead center of the swash plate 11" and the position of the swash plate that allows the piston 9 to be at bottom dead center is referred to as the "bottom dead center of the swash plate 11".

When the piston 9 compresses refrigerant gas in accordance with the rotation of the swash plate 11, a reactive force is applied to the swash plate by the piston 9. The greatest reactive force is applied to a region T (see FIG. 3) next to the top dead center position and the bottom dead center position. The region T is hereinafter referred to as the "greatest compression load region".

The suction chamber 30 and the discharge chamber 31 are defined in the rear housing 3. Suction ports 32 and discharge ports 33 are formed in the valve plate 4. The compression chamber, which is defined by the valve plate 4 and each piston 9, can be communicated with the suction chamber 30 and the discharge chamber 31 through the suction port 32 and the discharge port 33, respectively. A control valve (not shown) is provided in the rear housing 3 for controlling the pressure in the crank chamber 5.

Figure 3:
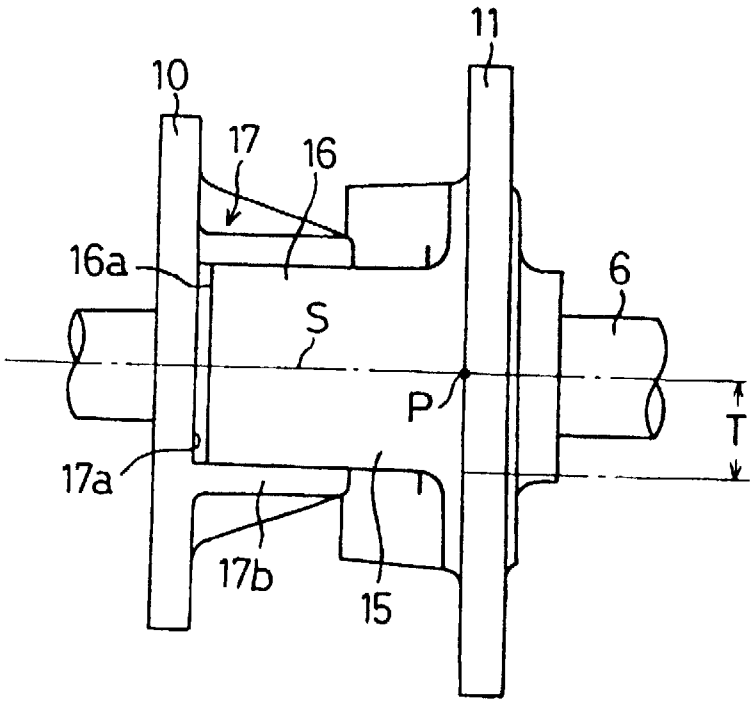
Figure 2:
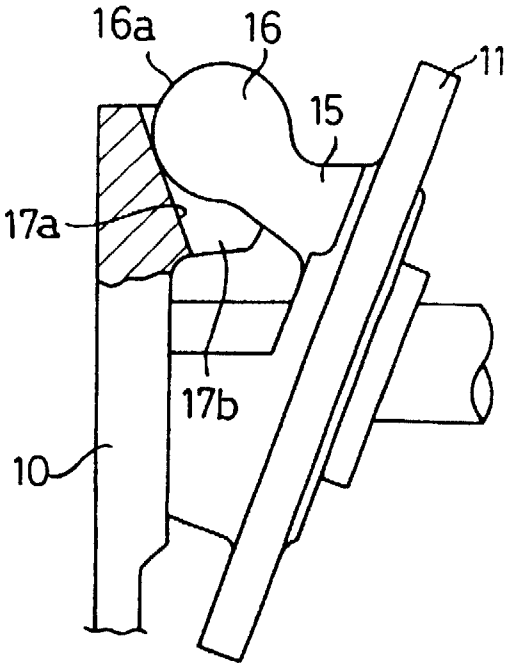
FIG. 2 is a partial side view, partly in cross section, illustrating a further embodiment of a hinge mechanism that couples a lug plate to a swash plate in a compressor.

As shown in FIGS. 2 and 3, an arms 15 is provided on the front surface of the swash plate 11 symmetric with respect to the plane that includes the top dead center P and the bottom dead center of the swash plate 11 and includes the axis of the drive shaft 6. An engaging receptacle 17 for supporting the arms 15 is formed on the top rear side of the lug plate 10. The arm 15 has a head 16 wide enough to have at least a portion aligned with the greatest compression load region T. The front end 16*a* of the head 16 is formed convex. The distal front end 16*a* extends perpendicular to the swash plate 11.

A wall 17*a* of the receptacle 17 on the lug plate 10 is tangential to the front the 16*a* and is inclined as seen in FIGS. 1 and 2. The guide wall 17*a* slidably contacts the arm's front end 16*a* for determining the piston's top dead center. A pair of side walls 17*b*hold the arm's head 16 therebetween. The space between the walls 17*b*is substantially equal to the width of the arm's head 16. The sides of the head 16 slidably contact the walls 17*b*. Thus, the receptacle 17 includes a channel having one end near the drive shaft 6 and one end farther from the drive shaft 6. The channel is inclined such that the end near to the drive shaft 6 is closer to the swash plate 11 than the other end.

The operation of the above compressor will now be described.

Rotating the drive shaft 6 by an external drive force rotates the swash plate 11 integrally with the shaft 6. The rotation of the swash plate 11 is converted into reciprocation of each piston 9 in the associated cylinder bore 8. This draws refrigerant gas from the suction chamber 30 into the compression chamber. The gas is compressed in the compression chamber and discharged into the discharge chamber 31. The volume of the discharged gas into the discharge chamber 31 is determined by the inclination of the swash plate 11, which is controlled based on the pressure adjustment in the crank chamber 5 by the control valve.

An increase in the pressure in the crank chamber 5 by the control valve's pressure control increases the pressure acting on the front end of each piston 9. This decreases the inclination angle of the swash plate 11. Specifically, the head 16 of the arm 15 in the hinge mechanism H rotates counterclockwise (as viewed in FIG. 2) so that the front end 16*a* slides on the guide wall 17*a* of the engaging receptacle 17 toward the drive shaft 6. The embodiment of FIG. 2 does not employ a shoe 18, therefore, there is direct contact between the head 16 and the wall 17*a*. However, in the embodiment of FIG. 1, the head slides against the shoe 18, which is discussed below. This alters the inclination of the swash plate 11 with respect to the axis of the drive shaft and the coil spring moves the swash plate 11 backward (to the right in FIG. 1). Accordingly, the inclination angle of the swash plate 11 and the stroke of each piston 9 are decreased. As a result, the displacement of the compressor is decreased. The compressor's minimum displacement is determined by contact between a counter bore surface 11*b* formed around the rear opening of the through hole 20 and a locating snap ring 13.

When the above compressor is operated with a small displacement, decreasing pressure in the crank chamber 5 by the control valve's pressure control decreases the pressure acting on the front end of each piston 9. This increases the inclination angle of the swash plate 11. Specifically, the head 16 of the arm 15 in the hinge mechanism H rotates clockwise so that the front end 16*a* slides on the guide wall 17*a* of the engaging receptacle 17 (or the shoe 18 of FIG. 1) away from the drive shaft 6. This inclines the swash plate 11 with respect to the axis of the drive shaft 6 and the swash plate 11 moves forward against the force of the coil spring. Accordingly, the inclination angle of the swash plate 11 and the stroke of each piston 9 are increased. As a result, the displacement of the compressor is increased. The compressor's maximum displacement is determined by the contact between a protrusion 11*a* formed on the front side of the swash plate 11 and the back surface 10*a* of the lug plate 10.

The hinge mechanism H has a very simple structure since it is chiefly constituted by the arm 15 protruding from the swash plate 11 and the receptacle 17 formed on the lug plate.

In FIG. 1, the shoe 18 is placed between the convex front end 16*a* and the guide wall 17*a*. This facilitates the machining of the convex front end 16*a*. The arm's front end 16*a* and the shoe 18 contact over an extended area. This structure wears the end 16*a* and the shoe 18 less than if they contact along a line.

The width of the arm's front end 16*a* is wide enough to align with the greatest compression load region T of the compression load acting on the swash plate 11. The entire width of the end 16*a* is supported by the guide wall 17*a* and the side walls 17*b*forming the receptacle 17. Therefore, even when the point of application of the load acting on the swash plate is changed, undesirable tilting of the swash plate 11 is prevented.

The arm 15 is integrally formed with the swash plate 11 and made of aluminum alloy or the like. This structure reduces the overall weight of the compressor compared with prior art compressors in which an iron pin is used. Further, the radius of curvature of the arm's front end 16*a* is extremely large compared to that of the pin in prior art compressors. This reduces the contact pressure between the end 16*a* and the guide wall 17*a*.

The through hole 20 is formed with a tapered opening. This allows the inclination of the swash plate 11 to be changed over its entire control range on the drive shaft 6. The swash plate does not transmit the moment acting on the swash plate to the drive shaft. However, the hinge mechanism H according to the present invention positively bears the moment acting on the swash plate 11.

Figure 6:
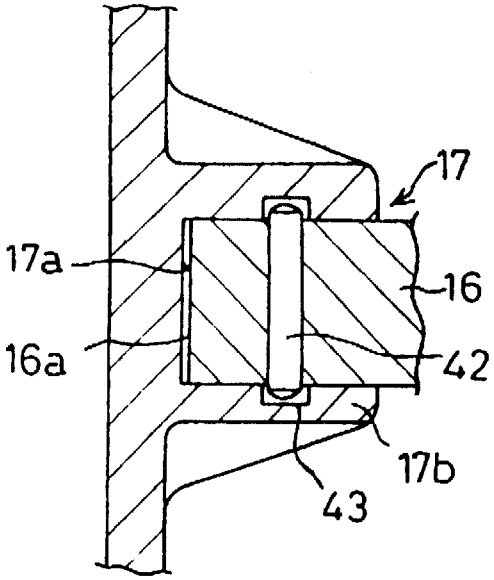
Figure 5:
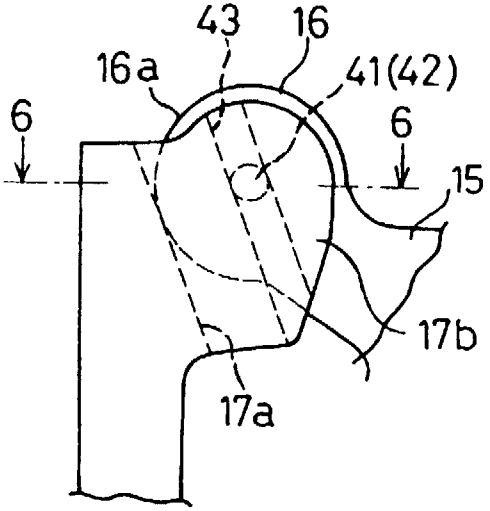
FIG. 5 is a partial side view illustrating a further embodiment including structure to prevent the hinge mechanism from breaking off.

In the embodiment shown in FIGS. 5 and 6, a through hole 41 is formed at the center of the convex surface of the arm's head 16.

The hole 41 is formed parallel to the front end 16*a* of the head 16 and accommodates a pin 42 extending therethrough. A groove 43 is formed on the inner side of each side wall 17*b*. The grooves 43 correspond to the path of the hole 41 and the pin 42. Each end of the pin 42 protrudes from the hole 41 and is inserted in each groove 43. In this manner, the pin 42 couples the arm 15 and the lug plate 10. Therefore, when load applied to the swash plate 11 disappears, such as when the compressor is stopped, the engagement of the pin 42 and the grooves 43 prevents the head 16 from rattling and the shoe 18 from coming off.

Figure 7:
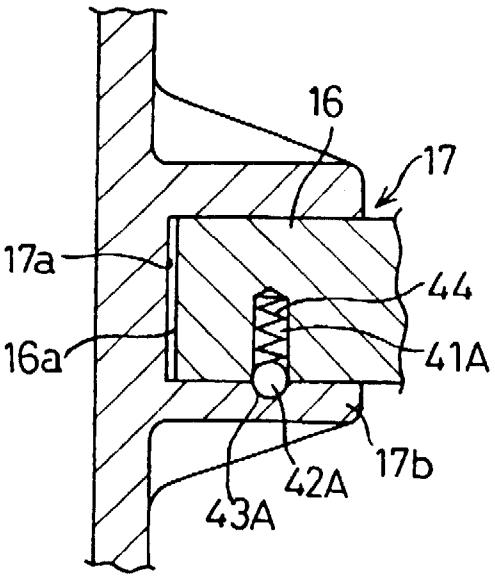
FIG. 7 is a partial plan cross-sectional view illustrating a break off prevention device according to another embodiment in a hinge mechanism.

FIG. 7 illustrates a further embodiment of the present invention. In this modification, a hole 41A is formed in the head 16 of the arm 15. The hole 41A has a spring 44 and a ball 42A, which is urged outward by the spring 44. The ball 42A is engaged with a groove 43A of the lug plate 10, which permits movement of the head 16.

Figure 4:
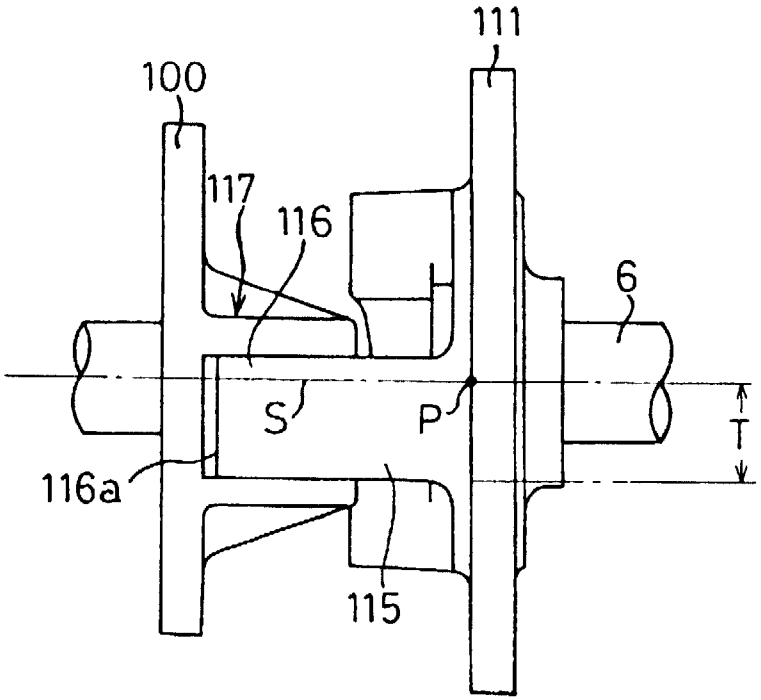
FIG. 4 is a partial plan view illustrating a hinge mechanism according to another embodiment.

FIG. 4 illustrates a further embodiment of the present invention. An arm 115 is formed shifted from the top dead center of the swash plate 111 towards the rotating direction of a swash plate 111. A lug plate 100 has a receptacle 117 for supporting the arm 15. The position of the receptacle 117 corresponds to the position of the arm 15. The arm 115 has a head 116 that extends perpendicular to the swash plate 111. The width of the head 116 is wide enough to align with the greatest compression load region T of compression load acting on the swash plate 111. The head 116 has a convex end 116*a*.

As described above, the head 116 of the arm 115 is aligned with a part of the swash plate 111 on which the compression load is applied. In other words, the head 116 covers the entire area of the greatest compression load region T. This reduces the size of the arm 115, thereby reducing the weight of the compressor.

The present examples and embodiments are to be considered as illustrative and not restrictive and the invention is not to be limited to the details given herein, but may be modified within the scope of the appended claims. The present invention may be embodied as a wobble plate type compressor.

What is claimed is:

1. A compressor having a rotating plate mounted on a drive shaft for integral rotation therewith, wherein rotation of the rotating plate is converted to linear reciprocal movement of a piston between a top dead center position and a bottom dead center position to compress gas, said rotating plate having a first point and a second point corresponding to the top dead center position and the bottom dead center position, respectively, said compressor comprising:

a lug plate mounted on the drive shaft for integral rotation therewith;

one of said lug plate and said rotating plate including a receptacle, and the other one of said lug plate and said rotating plate including an arm that is guided within the receptacle;

said receptacle being defined at least in part by a pair of side walls extending from said one of said lug plate and said rotating plate in a direction that is normal to the rotating plate, said side walls being spaced from each other by a predetermined distance; and said arm having a head portion with a width substantially equal to the distance separating the side walls, said head being received within said receptacle:

wherein said rotating plate receives a maximum reaction force of the compressed gas in a predetermined area that is laterally offset from a lane in which the first point, second point and axis of the drive shaft lie, and wherein said width of said head portion is such that at least part of said head portion is aligned with the predetermined area.

2. The compressor as set forth in claim 1, wherein said arm extends in a direction substantially perpendicular to the rotating plate, and wherein said head portion has a cylindrical shape, an outer surface of which extends in a direction perpendicular to the axis of the drive shaft, said head portion further having a pair of side surfaces, each slidably contacting an associated one of the side walls.

3. The compressor as set forth in claim 2, wherein said head portion is symmetrical with respect to the plane.

4.The compressor as set forth in claim 2 wherein said head portion is offset with respect to the plane.

5. The compressor as set forth in claim 1, wherein said receptacle includes a channel having a first end in the vicinity of the drive shafts a second end distant from the drive shaft, and said channel is inclined such that the first end is closer to the rotating plate than the second end.

6. The compressor as set forth in claim 5, wherein said coupling means includes a groove formed in either the head portion or one of the side walls and a bore provided in the other of the head portion and said one side wall, wherein a spring is fitted inside the bore and a ball is fitted in the groove such that the spring engages the ball and urges it into the groove to hold the arm in the receptacle.

7. The compressor as set forth in claim 5 further comprising means for coupling the arm to the lug plate, said coupling means being arranged to permit the arm to move within the channel.

8. The compressor as set forth in claim 7, wherein said coupling means includes a groove provided in at least one of the side walls of the receptacle, a bore provided in the head portion of the arm and a pin that is inserted into the bore and the groove.

9. The compressor as set forth in claim 7, wherein said rotating plate is a swash plate.

10. The compressor as set forth in claim 9, wherein said swash plate is made of aluminum alloy.

11. A compressor having a rotating plate mounted on a drive shaft for integral rotation therewith in a crank chamber, said rotating plate being tiltable according to the pressure in the crank chamber, wherein said rotation of the rotating plate is converted to linear reciprocal movement of a piston between a top dead center position and a bottom dead center position in a cylinder bore to compress gas introduced to a compression chamber from a suction chamber and discharge the compressed gas to a discharge chamber from the compression chamber; said compressor comprising:

a lug plate mounted on the drive shaft for integral rotation therewith;

one of said lug plate and said rotating plate including a channel, and the other one of said lug plate and said rotating plate including an arm guided along a longitudinal direction of the channel, said channel including a pair of side walls extending in a direction towards the rotating plate, said side walls being spaced apart by a predetermined distance, and wherein said arm extends perpendicular to the rotating plate; and wherein said arm includes a head portion having a cylindrical body, the axis of which extends perpendicular to an axis of the drive shaft, and wherein said head portion has a pair of end surfaces each slidably contacting the associated side wall.

12. The compressor as set forth in claim 11 further comprising means for coupling the arm to the lug plate, said coupling means being arranged to permit the arm to move within the channel.

13. The compressor as set forth in claim 12, wherein said coupling means includes a groove provided in at least one of the side walls of the receptacle, a bore provided in the head portion of the arm and a pin that is inserted into the bore and the groove.

14. The compressor as set forth in claim 12, wherein said coupling means includes a groove formed in either the head portion or one of the side walls and a bore provided in the other of the head portion and said one side wall, wherein a spring is fitted inside the bore and a ball is fitted in the groove such that the spring engages the ball and urges it into the groove to hold the arm in the receptacle.

15. The compressor as set forth in claim 12, wherein said rotating plate includes a swash plate.

16. The compressor as set forth in claim 15, wherein said swash plate is made of aluminum alloy.

17. The compressor as set forth in claim 16 further comprising a slidable shoe located between the head portion of the arm and the lug plate.

18. A compressor having a rotating plate mounted on a drive shaft for integral rotation therewith, wherein rotation of the rotating plate is converted to linear reciprocal movement of a piston between a top dead center position and a bottom dead center position to compress gas; said compressor comprising:

a lug plate mounted on the drive shaft for integral rotation therewith;

one of said lug plate and said rotating plate including a channel, and the other one of said lug plate and said rotating plate including an arm guided along a longitudinal direction of the channel, said channel including a pair of side walls extending in a direction towards the rotating plate, said side walls being spaced apart from each other by a predetermined distance, wherein said arm extends in a direction that is substantially perpendicular to the rotating plate;

a head portion having a cylindrical body, the axis of which extends perpendicular to an axis of the drive shaft, wherein said head portion has a pair of opposite end surfaces each slidably contacting an associated one of the side walls;

wherein said rotating plate has a first point and a second point, said first point and said second point respectively corresponding to the top dead center and the bottom dead center positions of the piston;

said rotating plate receiving a maximum reaction force of the compressed gas in a predetermined area, wherein said head portion has a length such that at least part of the head portion is aligned with the predetermined area.

* * * * *

UNITED STATES PATENT AND TRADEMARK OFFICE

CERTIFICATE OF CORRECTION

PATENT NO. : 5,785,503

DATED : July 28, 1998

INVENTOR(S) : Masaki Ota et al

In the Claims:

Column 2, lines 45-47 should read as follows:

"FIG. 3 is a partial plan view illustrating the hinge mechanism of FIG. 2;".

lines 53-55 should read as follows:

"FIG. 6 is a partial cross-sectional view taken along line 6-6 of FIG. 5;".

Column 3, line 59, after "allows", insert –the--.

Column 4, line 13, change "arms" to –arm--;
line 19, change "arms" to –arm--;
line 26, change "the" (second occurrence) to –end--.

Column 5, line 32, between "b" and "forming", insert a space.

Column 7, line 5, change "shafts" to –shaft--, and insert --,-- (comma) after "shaft";
line 31, delete "said".

UNITED STATES PATENT AND TRADEMARK OFFICE

CERTIFICATE OF CORRECTION

PATENT NO. : 5,785,503
DATED : July 28, 1998
INVENTOR(S) : Masaki Ota, et al.

It is certified that error appears in the above-identified patent and that said Letters Patent is hereby corrected as shown below:

Column 8, line 52, change "length" to --width--.

Signed and Sealed this

Twenty-sixth Day of January, 1999

*Attest:*

*Attesting Officer*

*Acting Commissioner of Patents and Trademarks*